US007456351B2

(12) United States Patent
Dorfman et al.

(10) Patent No.: US 7,456,351 B2
(45) Date of Patent: Nov. 25, 2008

(54) DRUM PEDAL

(75) Inventors: Michael Dorfman, Prairie View, IL (US); George Szwaya, East Troy, WI (US); Robert E. Szwaya, Milwaukee, WI (US)

(73) Assignee: Trick Percussion Products, Inc., Arlington Heights, IL (US)

( * ) Notice: Subject to any disclaimer, the term of this patent is extended or adjusted under 35 U.S.C. 154(b) by 373 days.

(21) Appl. No.: 11/217,757

(22) Filed: Sep. 1, 2005

(65) Prior Publication Data

US 2006/0156901 A1 Jul. 20, 2006

Related U.S. Application Data

(63) Continuation-in-part of application No. 11/039,130, filed on Jan. 19, 2005, now Pat. No. 7,405,352.

(51) Int. Cl.
*G10D 13/02* (2006.01)

(52) U.S. Cl. ..... 84/422.1

(58) Field of Classification Search ..... 84/422.1, 84/422.2, 422.3

See application file for complete search history.

(56) References Cited

U.S. PATENT DOCUMENTS 4,782,733 A * 11/1988 Herring ..... 84/422.1
5,398,584 A * 3/1995 Liao ..... 84/422.1
5,574,237 A 11/1996 Yanagisawa
6,137,040 A 10/2000 Hoshino
6,166,312 A 12/2000 Brewster et al.
6,570,076 B1 5/2003 Kjellgren
6,590,147 B2 7/2003 Kassabian (Continued)

OTHER PUBLICATIONS

Axis Percussion, "Axis A Single Pedal, Shown with Sonic Hammer," Jan. 18, 2005, website http://www.axispercussion.com/images/axa.jpg, 1 page.

American Musical Supply, "Ludwig Speed King Single Bass Drum Pedal," Jan. 18, 2005, website http://www.americanmusical.com/images/h/p23734h.jpg, 1 page.

*Primary Examiner*—Kimberly R Lockett
(74) *Attorney, Agent, or Firm*—Beem Patent Law Firm

(57) ABSTRACT

A drum pedal, having a drive assembly supported by a pedestal, may include a drive shaft, a rotatably adjustable drive ring, and a rotatably adjustable beater ring. In another aspect, a drum pedal may have a drive assembly supported by a pedestal comprising a journaled drive shaft, a rotatable bearing mounted off center of the drive shaft, a spring, and a biasing arm pivotally mounted on the pedestal, wherein the bearing and the spring cooperate to bias the arm toward a predetermined rest position. A linkage may operatively connect a foot board and the drive ring and may have means for selectively defining a connection to the foot board from one of plurality of positions. A beater may have a stem affixed to the beater ring. The beater may be actuated to a forward position when the foot board is depressed. The foot board may be biased toward a raised position and the beater may be biased toward a rearward position. In still another aspect, a drum pedal may have a drumward clamp, mountable to a bracket on the base, including a shaft, a rotatable arm, and a torsion spring for biasing the arm toward locking with a drum rim. The arm may be unlocked by rotating a lever connected to the shaft.

18 Claims, 10 Drawing Sheets

U.S. PATENT DOCUMENTS

2003/0047060 A1* 3/2003 Cocca ..... 84/422.1
2003/0226442 A1 12/2003 Dennis et al.
2004/0060421 A1 4/2004 Yun
2004/0144198 A1 7/2004 Gatzen

* cited by examiner

DRUM PEDAL

This application is a Continuation-In-Part of application Ser. No. 11/039,130 filed on Jan. 19, 2005 now U.S. Pat. No. 7,405,352.

BACKGROUND

1. Field of the Invention

This invention relates to musical instruments, more specifically, the invention is directed to a drum pedal providing an adjustable drive assembly, a cam feature and/or a clamp for connection to a drum.

2. Background of the Invention

Drummers typically use a pedal to strike a bass drum or the like. A bass drum pedal is operated by depressing a foot board and causing a beater to hit the surface of a drum. When the foot board is depressed, a drive assembly causes the beater to strike the drum. When the foot board is released, the beater returns to a ready position, ready for the next beat.

Drummers typically desire a range of adjustability in their bass drum pedals. Some drummers like their beater head to travel a larger arc than others in order to increase the range of the force at which the beater head strikes the drum. Some drummers like to have minimal foot board travel distance or minimal tension to conserve foot strength. Some drummers like to have their beaters accelerate faster during the arc in order to minimize the time between depression of the foot board and striking of the drum.

Conventional drum pedals do not allow easy adjustment of the beater head arc distance, the depression distance of the foot board, the depression tension of the foot board, or the acceleration of the beater toward the drum. Typical drum pedals lack durability to withstand rigors of use and handling.

SUMMARY OF THE INVENTION

In one embodiment of the invention, an adjustable drum pedal has a base, a foot board movable between a raised position and a depressed position, and a pedestal extending upwardly from the base. The drum pedal also has a drive assembly supported by the pedestal having a journaled drive shaft, a rotatably adjustable drive ring mounted on the drive shaft and having an arm, and a rotatably adjustable beater ring mounted on the drive shaft. A link connects the foot board with the arm. A beater has a stem affixed to the beater ring, wherein the beater is actuated to a forward position when the foot board is depressed. The foot board is biased toward a raised position and the beater is biased toward a rearward position.

In another aspect, a drum pedal has a base, a foot board, and a pedestal extending upwardly from the base. A drive assembly supported by the pedestal has a journaled drive shaft, a cam mounted on the drive shaft having a slope, a spring, and a cam follower. The cam and the spring cooperate to bias the cam follower toward a predetermined rest position. The cam follower is moved onto the slope when the foot board is depressed. The drum pedal also has a link operatively connecting the foot board to the drive shaft. The link may have a plurality of positions for adjustable connection to the foot board. A beater has a stem operatively connected to the drive shaft. The cam may also be further provided with a second slope and an indentation between the two slopes wherein the predetermined position is in the indentation.

In further aspects of the invention, the drive assembly may contain at least one bearing facilitating rotation of the drive shaft. The drive assembly may have a support ring, and the support ring may have a predetermined axial length sufficient to keep the drive shaft aligned substantially axially. The link may be adjustable in length. The spring in the drive assembly may be a compression spring. The drum pedal also may have a tension adjuster for the spring. The pedestal also may be made from aluminum casting.

In yet a further aspect, a drum pedal has a drumward end and a base has a drumward end. The drum pedal has a movable foot board, a beater operatively connects to the foot board and is actuated thereby. A clamp, operatively connected to the drumward end of the drum pedal, has a shaft, a rotatable arm operatively connectable to the shaft, and a torsion spring mounted around the shaft to bias the arm to lock with a drum rim. A lever mounted to the shaft may be rotatable to unlock the arm from the drum rim. The clamp may be operatively connected to the pedestal. The arm may have a stop for engaging the spring. The drumward end of the base may be provided with a gripping surface generally opposite the arm.

In still another aspect of the invention, biasing arm embodiment of the drum pedal may have a drive assembly supported by a pedestal having a journaled drive shaft, a rotatatable bearing mounted off center of drive shaft, a spring, a biasing arm pivotally mounted on the pedestal, wherein the bearing and the spring cooperate to bias biasing arm toward predetermined rest position, a linkage operatively connecting a foot board to the drive shaft, a beater operatively connected to the drive shaft, wherein the bearing displaces the biasing arm and compresses the spring when the foot board is depressed. A tension adjuster may form an angle between about 30 degrees and about 150 degrees with respect to the longitudinal axis of the pedestal. The beater may be actuated to a forward position when the foot board is depressed and to a rearward position when the foot board is not depressed.

In still yet a further aspect of the invention, a drum pedal may have a base having a drumward end, a moveable foot board situated above the base, a beater operatively coupled to the foot board and actuated thereby, a bracket mountable to the drumward end, and a clamp operatively connected to the bracket, the clamp having a shaft, a rotatable arm mounted to the shaft, a torsion spring mounted around the shaft and biasing the arm to lock with a drum rim, and a lever operatively connectable to the shaft and rotatable to lock and unlock the arm from the drum rim. The bracket may be adjustable along a range of positions defined by a plurality of slots in the base, each having a length of between about 0.3 inches and about 2 inches.

In another aspect of the invention, a drum pedal may have a base, a foot board, a pedestal with an axis extending upwardly from the base, a drive assembly supported by the pedestal having a journaled drive shaft, a beater operatively connected to the drive shaft, and a linkage operatively connecting the foot board to the die shaft, wherein the linkage includes an elongate link having a toe portion and a drive portion, wherein the toe portion has means for selectively defining a connection to the foot board from one of a plurality of positions. The means may include bearings having open centers for receiving a pin.

DETAILED DESCRIPTION OF THE INVENTION

Figure 1:
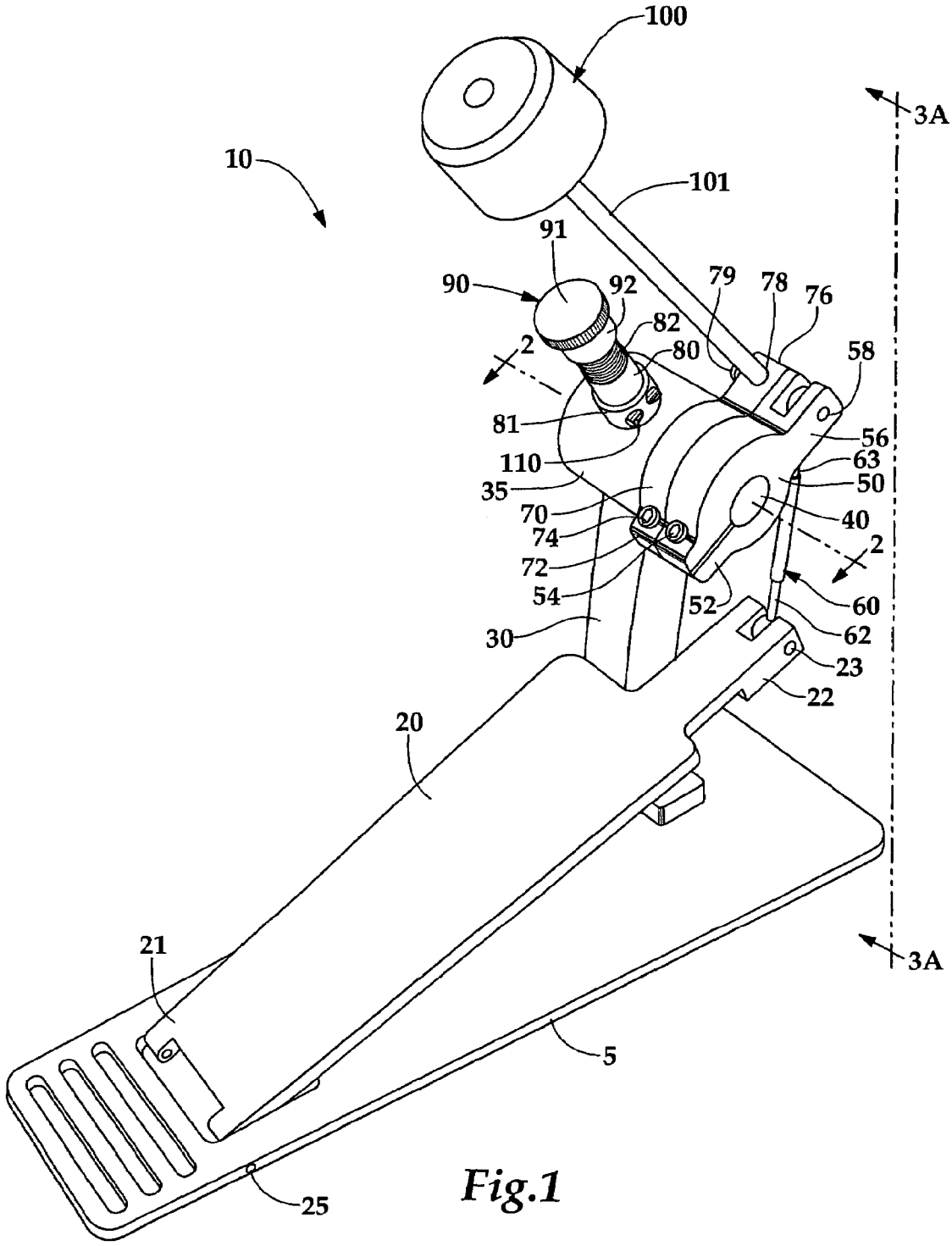
FIG. 1 is a perspective view of one embodiment of a bass drum pedal.
Figure 2:
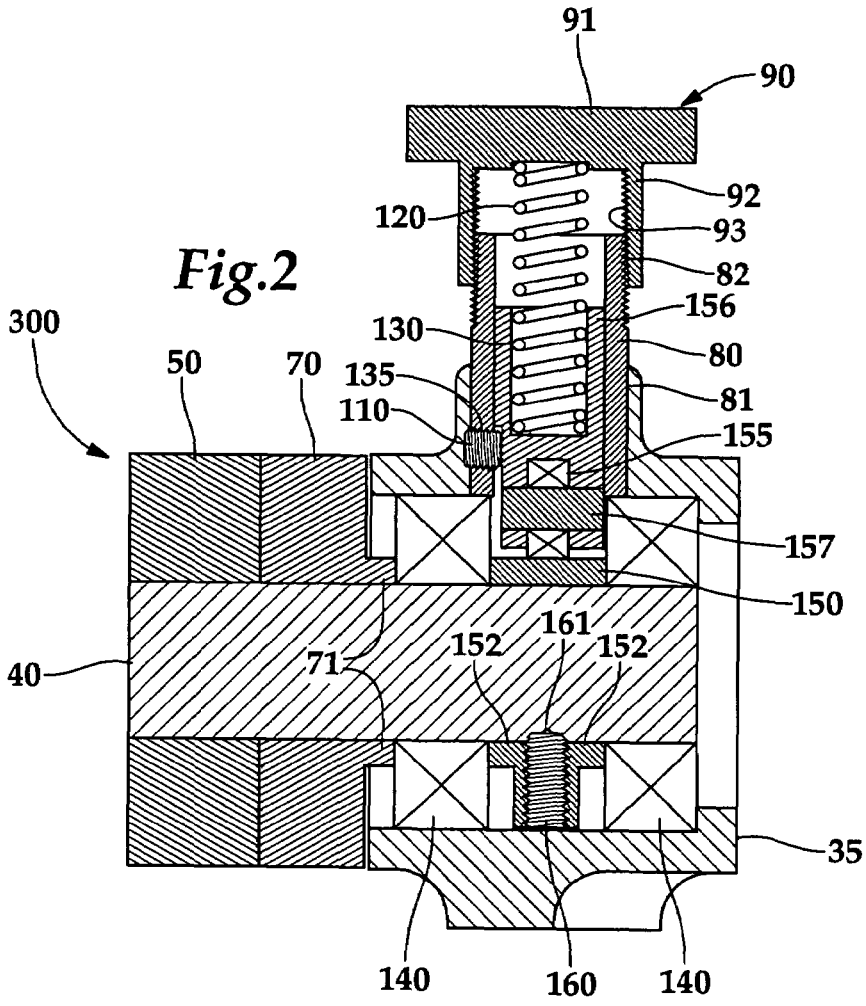
FIG. 2 is a cross section of the drive assembly of FIG. 1 along lines 2-2.
Figure 7:
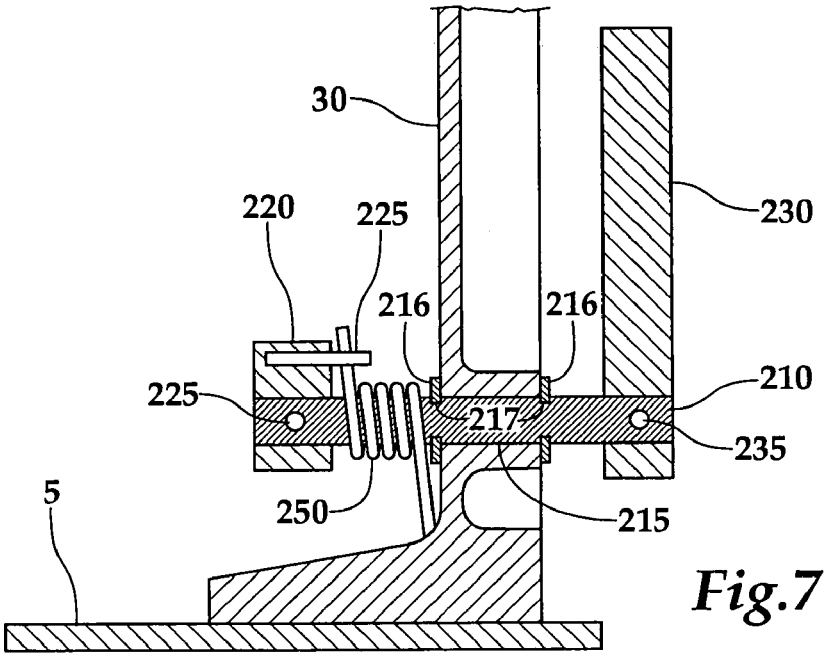
FIG. 7 is a cross section of the clamp of FIG. 6A along lines 7-7.
Figure 8:
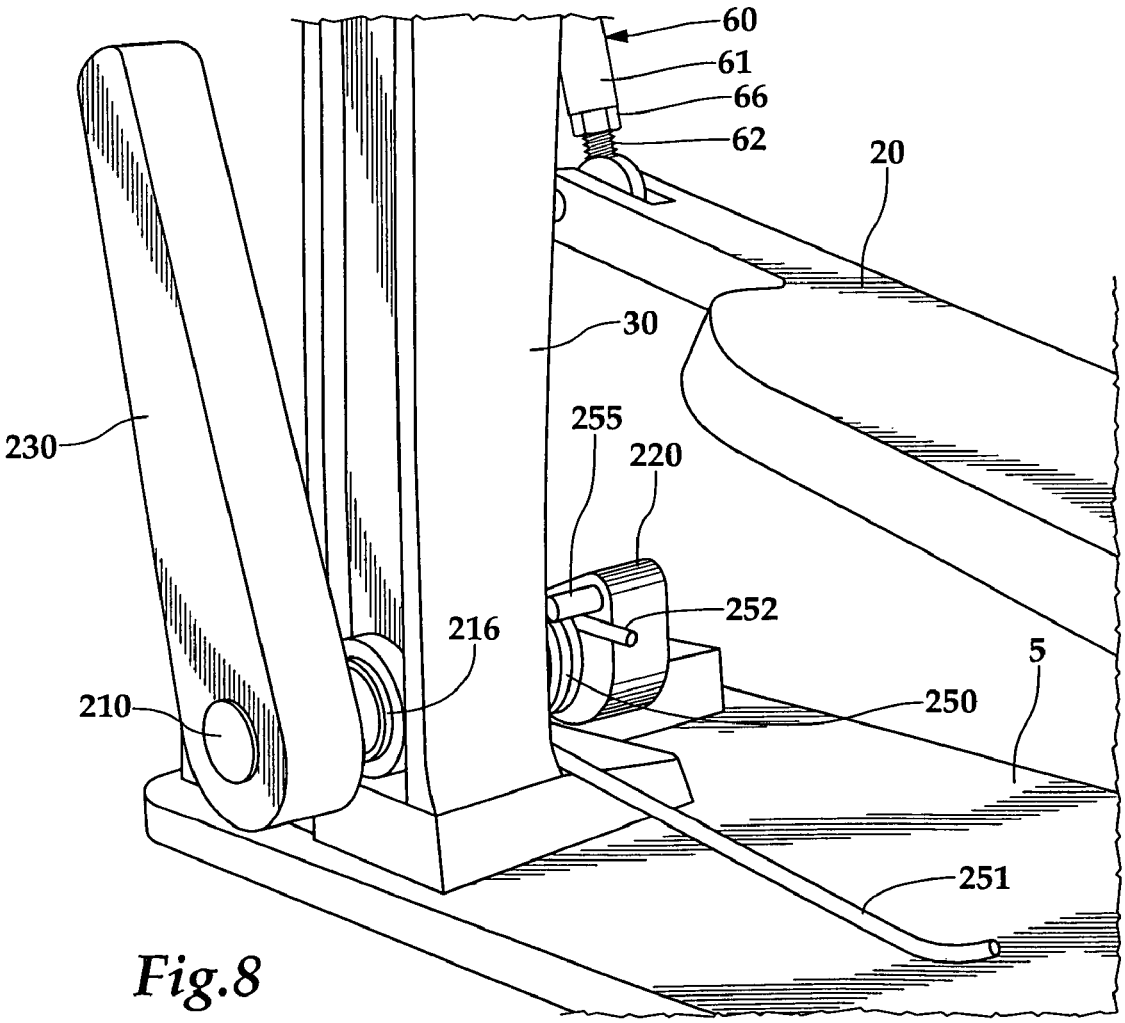
FIG. 8 is a perspective view of a clamp.

As shown generally in FIGS. 1 and 2, a drum pedal 10, having a drive assembly 300 (see FIG. 2) supported by a pedestal 30, may include a drive shaft 40, a rotatably adjustable drive ring 50 having arm 56, and a rotatably adjustable beater ring 70. Link 60 may connect foot board 20 with arm 56. Beater 100 may have stem 101 affixed to beater ring 70. Beater 100 may be actuated to a forward position when foot board 20 is depressed. Foot board 20 may be biased toward a raised position and beater 100 may be biased toward a rearward position. As shown generally in FIG. 2, in another aspect, drum pedal 10 may have drive assembly 300 with cam 150, having slope 166 (see FIG. 4), mounted on drive shaft 40. Cam 150 and spring 120 may cooperate to bias cam follower 155 toward a predetermined rest position. Tension adjuster 90 may be provided to easily change the tension of spring 120. As generally shown in FIG. 6-8, in still another aspect, drum pedal 10 may have a drumward clamp 200 including shaft 210, rotatable arm 220, and torsion spring 250 for biasing arm 220 toward locking with a drum rim. Arm 220 may be unlocked by rotating lever 230 connected to shaft 210.

I. Adjustable Drive Ring and Beater Ring

As shown generally in FIG. 1, drum pedal 10, having drive assembly 300 supported by pedestal 30, may include drive shaft 40, rotatably adjustable drive ring 50 having arm 56, and rotatably adjustable beater ring 70. In one embodiment of FIG. 1, drum pedal 10 may have base 5, foot board 20, and beater 100 actuated by depression of foot board 20. The force exerted by foot board 20 on beater 100 may be adjustable through use of drive ring 50 and link 60. The arc distance beater 100 must travel in order to contact a drum may also be adjustable through beater ring 70. In one embodiment, drum pedal 10 shown in FIG. 1 may have base 5 that may be trapezoidal in shape. Foot board 20 may have two ends, heel end 21 and toe end 22. Heel end 21 may pivotally attach to base 5 by heel pin 25. Foot board 20 may reside at an incline in relation to base 5 with heel end 21 in contact with base 5 and toe end 22 suspended some distance above base 5. Foot board 20 may move from a raised position to a depressed position. The raised position also may be called a ready position and the depressed position may be called a strike position.

As shown in FIG. 1, pedestal 30 extends upwardly from base 5 and supports drive assembly 300. In one embodiment, pedestal 30 may have a support ring 35 near the top of pedestal 30. Pedestal 30 may be mounted on, and affixed to, base 5. There may be two pedestals 30 (not shown), but advantageously a single pedestal may be sufficient as shown in FIG. 1. Pedestal 30 and support ring 35 may be of unitary construction of aluminum casting and may be firmly affixed to base 5 by screws coming up from base 5 and extending into the base of pedestal 30. Unitary aluminum construction may prevent support ring 35 from twisting in relation to pedestal 30 and disorienting drive shaft 40. Drive shaft 40 should be oriented generally normal to the axis of the arc traveled by beater 100.

Drive shaft 40 may be journaled at one or more points along its axis or at both ends. As shown in FIG. 1, in one embodiment, drive shaft 40 may be journaled within housing or support ring 35. Drive shaft 40 extends generally horizontally through center of support ring 35. Support ring 35 may have a predetermined axial length sufficient to keep drive shaft 40 aligned generally normal to the axis of the arc traveled by beater 100. Axial length for a single support ring 35 may be between about 0.5 cm and about 10 cm, more preferably between about 1 cm and about 7 cm, and most preferably between about 2 cm and about 5 cm. If two or more support rings are provided, they should be spaced along drive shaft 40. As discussed below, two or more axially spaced bearings within support ring 35 may help keep drive shaft 40 substantially aligned.

As shown in FIG. 1, drive ring 50 may be one ring clamped onto drive shaft 40. Drive ring 50 may be adjustable in orientation about drive shaft 40. Drive ring 50 may have drive clamp protrusion 52 that may be slit from the end of drive clamp protrusion 52 to drive shaft 40 resulting in two drive protrusion ends that may be uncoupled from drive shaft 40. Drive ring screw 54 holds together both drive clamp protrusion ends to keep drive ring 50 tightly affixed to drive shaft 40. Drive ring 50 also may have arm 56 on the opposite end of drive ring 50 from drive clamp protrusion 52. Arm 56 may have link pin 58 that pivotally attaches to drive portion 63 of link 60. Link pin 58 may be spaced a predetermined distance from drive shaft 40 by arm 56. Arm 56 may provide leverage for force exerted on drive ring 50 by link 60. Toe portion 62 may be pivotally attached by toe pin 23 to toe end 22 of foot board 20.

Figure 4:
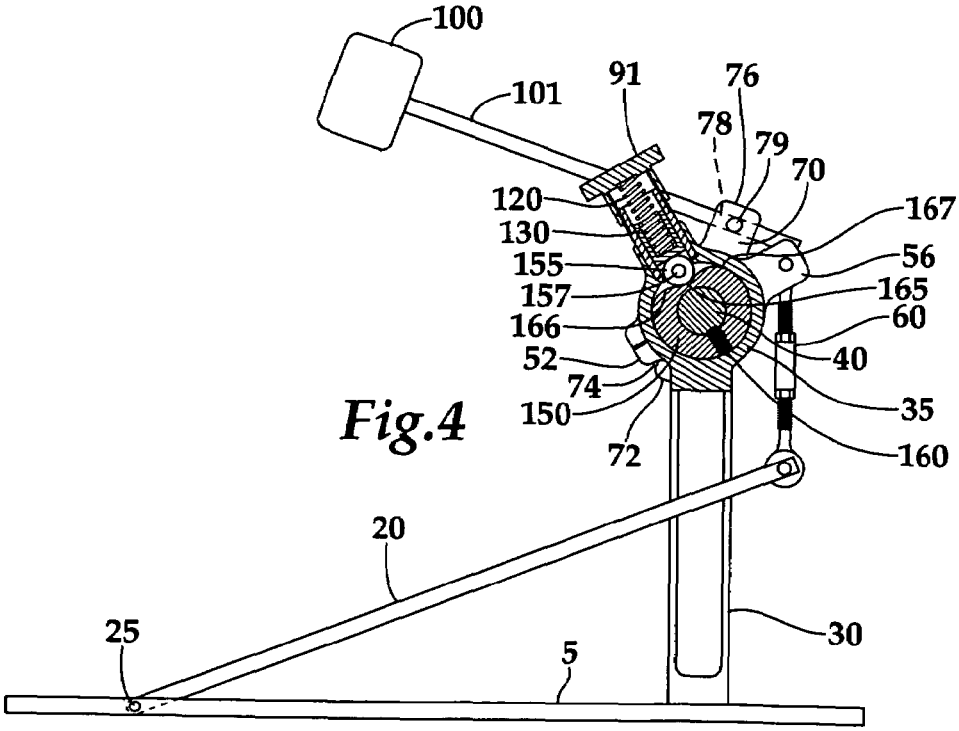
FIG. 4 is similar to FIG. 3A but shows a different beater angle.
Figure 5A:
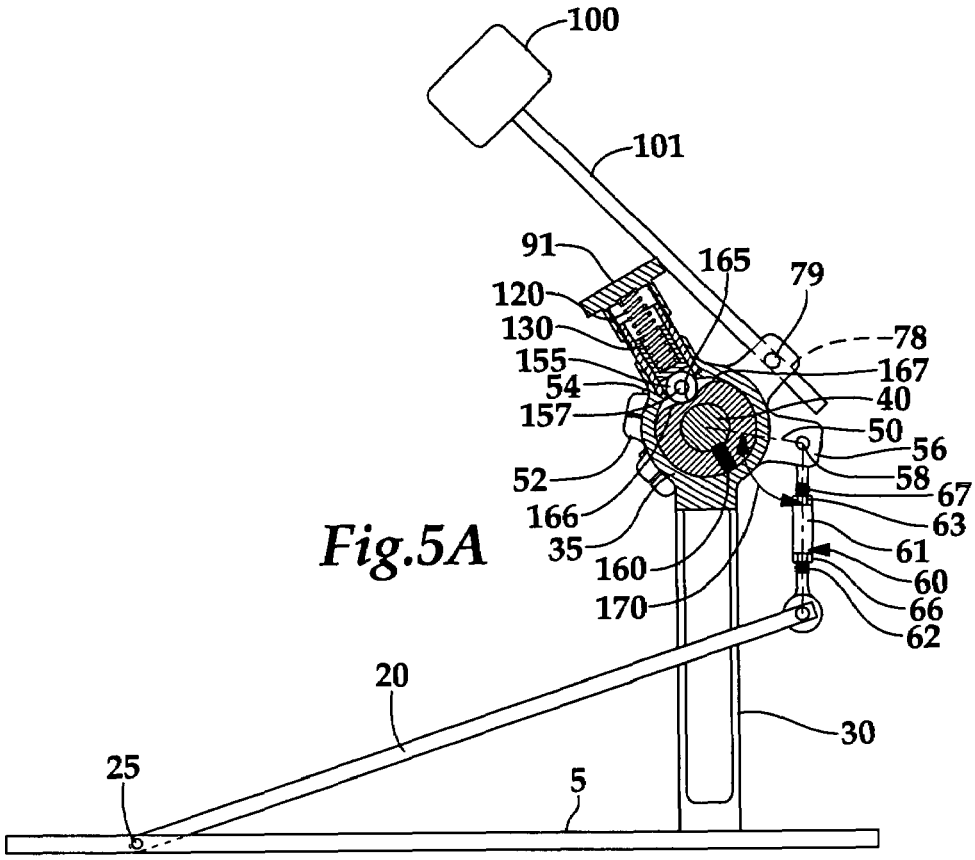
FIG. 5A is similar to FIG. 3A but shows an obtuse crank angle.
Figure 5B:
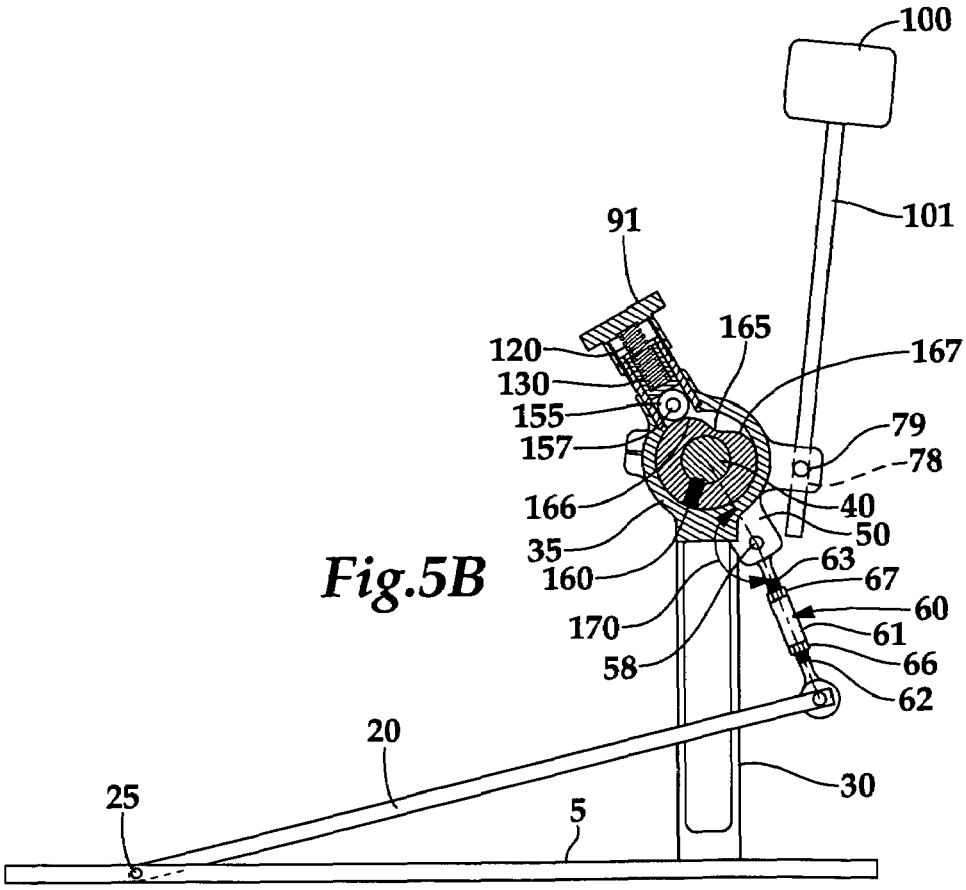
FIG. 5B is similar to FIG. 3A but shows a different crank angle in the strike position.

As shown in FIG. 5A and FIG. 5B, drive ring 50 may be adjusted to different orientations around drive shaft 40. Drummers are provided with a range of speed and a range of acceleration with which beater 100 moves toward a drum in order to best control the rhythm of the beat. Crank angle 170 may be formed at drive rod hinge 58 measuring the angle between link 60 and the line formed from drive shaft 40 to drive rod hinge 58. Crank angle 170 affects the speed with which the head of beater 100 may be accelerated toward the surface of the drum. When crank angle 170 is acute in the ready position, as seen in FIG. 4, the depression of foot board 20 may cause beater 100 to accelerate in velocity until crank angle 170 reaches 90 degrees, and then decelerate in velocity after crank angle exceeds 90 degrees. As seen in FIG. 5A and FIG. 5B when drive ring 50 is adjusted so that crank angle 170 is 90 degrees or more at the ready position, beater may decelerate towards drum surface upon depression of foot board 20. Since different drummers have different senses of timing, the a range of accelerations and decelerations of the beater is an important variable to have available.

In FIG. 5A, crank angle 170 is greater than 90 degrees at the ready position. Crank angle 170 may be changed by adjusting the orientation of drive ring 50. Drive ring screw 54 may be loosened so that drive clamp protrusion 52 may have two uncoupled ends. Loosening drive ring screw 54 allows drive ring 50 to unclamp from drive shaft 40. The orientation of drive ring 50 may be changed so that drive clamp protrusion 52 points horizontally or upwardly, as shown in FIG. 4. The more upwardly drive clamp protrusion 52 points, the greater crank angle 170 is. Tightening drive ring screw 54 may tightly couple the two ends of drive clamp protrusion 52, thus clamping drive ring 50 tightly to drive shaft 40 in the new orientation. Drive ring 50 preferably may have an about 120 degree range of adjustment, more preferably may have an about 100 degree range of adjustment, and most preferably may have an about 90 degree range of adjustment. Having adjustable drive ring 50 gives drummers many more options in controlling beater 100.

Figure 3A:
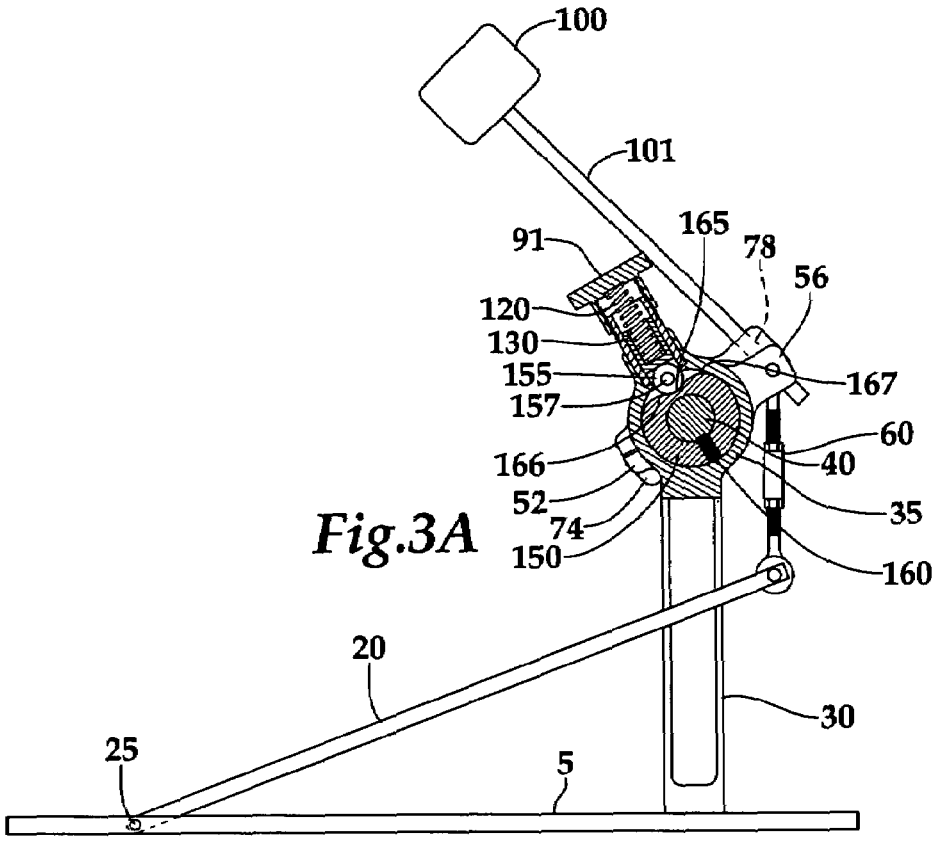
FIG. 3A is a cross section of bass drum pedal of FIG. 1 along lines 3A-3A.
Figure 3B:
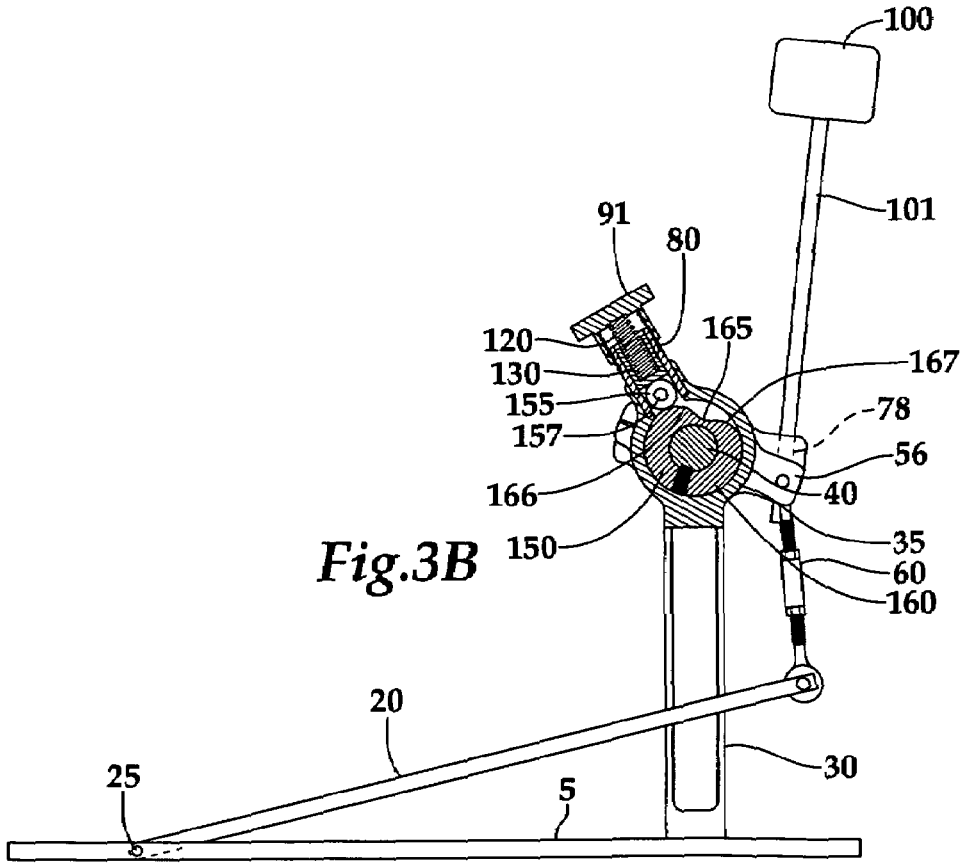
FIG. 3B is similar to FIG. 3A but shows a strike position.

Referring to FIG. 3-5, when crank angle 170 is adjusted, the length of link 60 also may have to be adjusted. Link 60 may have link body 61, toe portion 62, and drive portion 63. The length of link 60 may be adjustable by twisting link body 61 and securing link body 61 with toe nut 66 and drive nut 67. Link 60 may have left handed screw grooves located on toe portion 62 and right handed screw grooves located on drive portion 63. Link 60 may be shortened by twisting link body 61 to the right and lengthened by twisting link body 61 to the left. Shortening link 60 increases the angle of foot board 20 with respect to the floor. Toe nut 66 secures link body 61 by screwing to toe portion 62. Drive nut 67 secures link body 61 by screwing to drive portion 63. When drive ring 50 is adjusted about drive shaft 40 so that crank angle 170 is acute, as seen in FIG. 3A and FIG. 3B, link 60 may have to be lengthened so that foot board 20 may not be inclined too steeply as to be uncomfortable to operate. When crank angle 170 is obtuse, as seen in FIG. 5A and FIG. 5B, link 60 may have to be shortened so that foot board 20 may not hit base 5 during depression.

As generally shown in FIG. 4, besides adjustable drive ring 70, drum pedal 10 may also have adjustable beater ring 70. Adjustable beater ring 70 allows a drummer to set the predetermined arc distance beater 100 must travel to strike a drum. Beater ring 70 may be situated between drive ring 50 and support ring 35. Beater ring 70 may have beater clamp protrusion 72 that may be slit from the end of beater clamp protrusion 72 to drive shaft 40 resulting in two beater protrusion ends. Beater ring screw 74 screws together both beater protrusion ends to keep beater ring 70 tightly affixed to drive shaft 40. Beater ring 70 also may have holder protrusion 76 on opposite end of beater ring 70 from beater clamp protrusion 72 and holder protrusion 76 may have beater stem hole 78 extending through holder protrusion 76 for holding stem 101 of drum beater 100. Beater stem screw 79 fits into the side of holder protrusion 76 to hold stem 101. Beater stem screw 79 may be loosened to adjust the length of stem 101 held between holder protrusion 76 and beater 100. Beater stem screw 79 may be tightened to keep stem 101 from moving within beater stem hole 78. Beater 100 may be actuated by drive shaft 40 in connection with foot board 20 from a rearward position to a strike position. The rearward position may be called the ready position and occurs when foot board 20 is in the raised position. The strike position may be when foot board 20 is in a depressed position.

As shown in FIG. 4, beater ring 70 may be adjustable to control the arc distance beater 100 travels to strike the surface of a drum. Beater 100 may be set so stem 101 is oriented close to perpendicular and beater 100 travels a short arc distance before striking the surface of the drum. Foot board 20 may not need to be depressed very far to actuate beater 100 to strike the surface of the drum when stem 101 is oriented close to perpendicular. As seen in FIG. 4, beater 100 may be set so that stem 101 is oriented closer to horizontal at the ready position. When beater 100 is oriented as seen in FIG. 4, beater 100 may have to travel a longer arc distance to strike the surface of the drum. Foot board 20 may have to be depressed a greater distance downwardly to actuate beater 100 to travel the longer arc distance to the surface of the drum from the ready position. The distance of the beater arc may also affect the speed at which beater 100 strikes the surface of the drum. A longer arc distance allows beater 100 more time to accelerate towards the drum. An adjustable beater ring 70 allows drummers more options in fine tuning the operation of their instruments.

Beater ring screw 74 may be loosened so that beater clamp protrusion 72 may have two uncoupled ends. Loosening beater ring screw 74 allows beater ring 70 to unclamp from drive shaft 40. The orientation of beater ring 70 may be changed so that beater clamp protrusion 72 points more downwardly, as shown in FIG. 4. This causes beater stem hole 78 to orient close to horizontal and causes beater 100 to travel a longer arc distance to strike the drum. Tightening beater ring screw 74 may tightly couple the two ends of beater clamp protrusion 72, thus clamping beater ring 70 tightly to drive shaft 40 in the new orientation. The angles of adjustment of beater ring 70 may preferably be between about 100 degrees from horizontal and about the angle of the surface of the drum, more preferably between about 80 degrees from horizontal and about the angle of the surface of the drum, and most preferably between about 60 degrees and about the angle of the surface of the drum.

Foot board 20 actuates beater 100 through drive assembly 300. In FIG. 2, drive assembly 300 may have drive shaft 40 with a generally horizontal axis journaled within drive assembly 300. In a preferred embodiment, drive shaft 40 may be positioned generally horizontally by support ring 35. Drive assembly 300 comprising drive ring 50, beater ring 70, roller bearings 140, and cam 150, all affixed to drive shaft 40 may be suspended in place by drive shaft 40 partially extending through support ring 35. Roller bearings 140 and cam 150 actually reside within support ring 35.

Tube 80, with screw grooves 82, fits within tube support 81 and extends away from support ring 35. Tube 80 may contain a compression spring 120. Tension adjuster 90 may have spring cylinder 92 that fits over spring 120 and partially houses spring 120. Tension adjuster 90 also may have handle 91 to enable easy twisting of tension adjuster 90. Spring cylinder 92 may have cylinder grooves 93 on inside of spring cylinder 92 to screw into screw grooves 82 on tube 80. Twisting tension adjuster 90 allows easy adjustment of the tension of spring 120 without tools. Adjusting tension of spring 120 affects the force necessary to actuate beater 100 toward a drum. The higher the tension of spring 120, the more force necessary to actuate beater 100. The more spring cylinder 92 may overlap with tube 80, the more spring 120 may be compressed and the higher the spring tension may be.

Preferably tube 80 may be located at between about 45 degrees and about 80 degrees with respect to base 5, more preferably at between about 50 degrees and about 70 degrees with respect to base 5, and most preferably at about 60 degrees with respect to base 5. The angle of tube 80 should be optimal for a drum player to make adjustments to the spring tension by twisting handle 91 of tension adjuster 90.

II. Cam

As shown generally in FIG. 2, in another aspect, drum pedal 10 may have drive assembly 300 with cam 150, having slope 166 (see FIG. 4), mounted on drive shaft 40. Cam 150 and spring 120 may cooperate to bias cam follower 155 toward a predetermined rest position. Tension adjuster 90 may be provided to easily change the tension of spring 120. Cam 150 may be affixed to drive shaft 40 by cam locking screw 160 which penetrates cam 150 through a hole which extends from the perimeter of cam 150 to its center, and contacts dimple 161 in drive shaft 40. When cam locking screw 160 may be in place, the edge of cam locking screw 160 may be even with the perimeter of cam, and the point of cam locking screw 160 may be in contact with dimple 161 on drive shaft 40.

As shown in FIG. 2, roller bearings 140 contact drive shaft 40 and facilitate rotation of drive shaft 40 about its axis. Preferably there are two roller bearings 140 spaced on either side of cam 150 to help keep drive shaft 40 substantially aligned axially. Cam 150 may have cam flanges 152 in order to space cam 150 apart from roller bearings 140. Cam plunger 130 may be wider than cam follower 155 and cam plunger 130 may interfere with roller bearings 140 when cam follower 155 rolls along cam 150. Cam flanges 152 create space on either side of cam 150 so cam plunger 130 may not interfere with roller bearings 140 during operation of cam 150. Roller bearings 140 are preferably double shielded R12 bearings and are located on either side of cam 150. Beater ring 70 may have beater flanges 71 to space beater ring 70 apart from roller bearings 140 to ensure beater ring 70 may not interfere with the function of roller bearings 140.

As generally shown in FIG. 2, cam plunger 130 fits within tube 80 and may have cam follower 155 at one end and spring end 156 at the other end for partially housing spring 120. Cam 150 cooperates with spring 120 to bias cam follower 155 toward a predetermined position on cam 150. The cooperation of cam 150 with spring 120 provides an easy way to control the force needed to actuate beater 100. Compression of spring 120 within tube 80 biases cam plunger 130 with cam follower 155 toward cam 150. Cam follower 155 preferably may be a wheel that may attach to an end of cam plunger 130 by cam axle 157. Cam follower 155 contacts and rolls along outer perimeter surface of cam 150. Locking pin 110 fits in a hole that extends through tube support 81 and tube 80. Locking pin 110 contacts cam plunger 130 at pin niche 135 which may be an area under a shoulder on the side of cam plunger 130. Locking pin 110 keeps cam plunger 130 oriented such that cam follower 155 may roll along only the outer perimeter surface of cam 150. When locking pin 110 extends through tube support 81 and tube 80, and contacts pin niche 135, cam plunger 130 cannot turn within tube 80.

FIGS. 3A and 3B show the engagement of cam follower 155 with cam 150 in the ready position. Cam follower 155 may roll in same plane as cam 150 pivots. Cam 150 may have a predetermined position adjacent to drive slope 166 into which cam follower 155 may be biased. In a preferred embodiment, cam 150 may have indentation 165 between two generally convexly curved slopes, drive slope 166 and retention slope 167. In the preferred embodiment, the predetermined position may be located in indentation 165. Slopes 166 and 167 curve inwardly (toward the cam axis) in the region of indentation 165. Cam follower 155 may naturally rest at indentation 165 because spring 120 may be at its most extended state when cam follower 155 may be positioned there. Spring 120 may be a compression spring and may be at its lowest potential energy when at its most extended state. When cam follower 155 may be at rest in indentation 165, as seen in FIG. 3A, drum pedal 10 may be in the ready position and beater 100 may be held in a rearward position away from the surface of a drum by stem 101 held in beater ring 70. Spring 120 may be easily adjustable by tension adjuster 90 and the shape of cam 150 allows tension of spring 120 to affect rotation of cam 150. The higher the tension of spring 120, the greater the biasing force on cam follower 155.

In FIG. 3B, drum pedal 10 may be in the strike position. In the strike position, foot board 20 may be depressed, link 60 pulls arm 56 downwards, and roller bearings 140 turn within support ring 35 to allow drive shaft 40 to pivot in the clockwise direction. Cam 150 locked to drive shaft 40 may also pivot clockwise and cam follower 155, fixed to the end of cam plunger 130 held in place by tube 80, may be forced to roll up drive slope 166. When beater 100 contacts the surface of the drum at the strike position, cam follower 155 may be in contact with a portion of drive slope 166 and spring 120 may be compressed within tube 80. Spring 120 may be adjusted to have a high spring tension, and more force may be required to pivot cam 150 and move cam follower 155 onto drive slope 166. Adjusting spring tension by adjuster 190 adjusts the force necessary to pivot cam 150 and therefore, the force necessary to depress foot board 20 and move beater 100 into the strike position.

As shown in FIG. 3B, depression of foot board 20 actuates beater 100 into traveling an arc distance toward a drum. Drive slope 166 and retention slope 167 on cam 150 allow beater 100 to actuate at a range of preferably between about 90 degrees forward and about 90 degrees backward from the ready position, more preferably between about 75 degrees forward and about 75 degrees backward from the ready position, and most preferably between about 60 degrees forward and about 60 degrees backward from the ready position. The degree beater 100 actuates toward a drum may depend on the length of drive slope 166. The longer the length of drive slope 166, then the larger the range of arc lengths that beater 100 may actuate.

When foot board 20 is released, pressure exerted by compressed spring 120 on cam plunger 130 may force cam follower 155 to roll towards indentation 165 back to the ready position because spring 120 may be more extended when at rest in indentation 165 than on drive slope 166. If cam follower 155 rolls past indentation 165 onto retention slope 167 after release of foot board 20, cam follower 155 may roll back towards indentation 165 because retention slope 167 also compresses spring 120. Thus, retention slope 167 ensures that cam follower 155 returns to indentation 165 and drum pedal 10 returns to the ready position when foot board 20 is not depressed.

III. Clamp

As generally shown in FIG. 6-8, in still another aspect, drum pedal 10 may have a drumward clamp 200 including shaft 210, rotatable arm 220, and torsion spring 250 for biasing arm 220 toward locking with a drum rim. Arm 220 may be unlocked by rotating lever 230 connected to shaft 210. Clamp 200 using spring 250 may be attached to drum pedal 10 to hold and position a bass drum in front of drum pedal 10. Drum pedal 10 may have drumward end 201 that includes pedestal 30. Base 5 may have drumward end 202 that may include the entire upper surface of base 5, and more preferably includes the front half of base 5, and most preferably the front third of base 5.

Figure 6A:
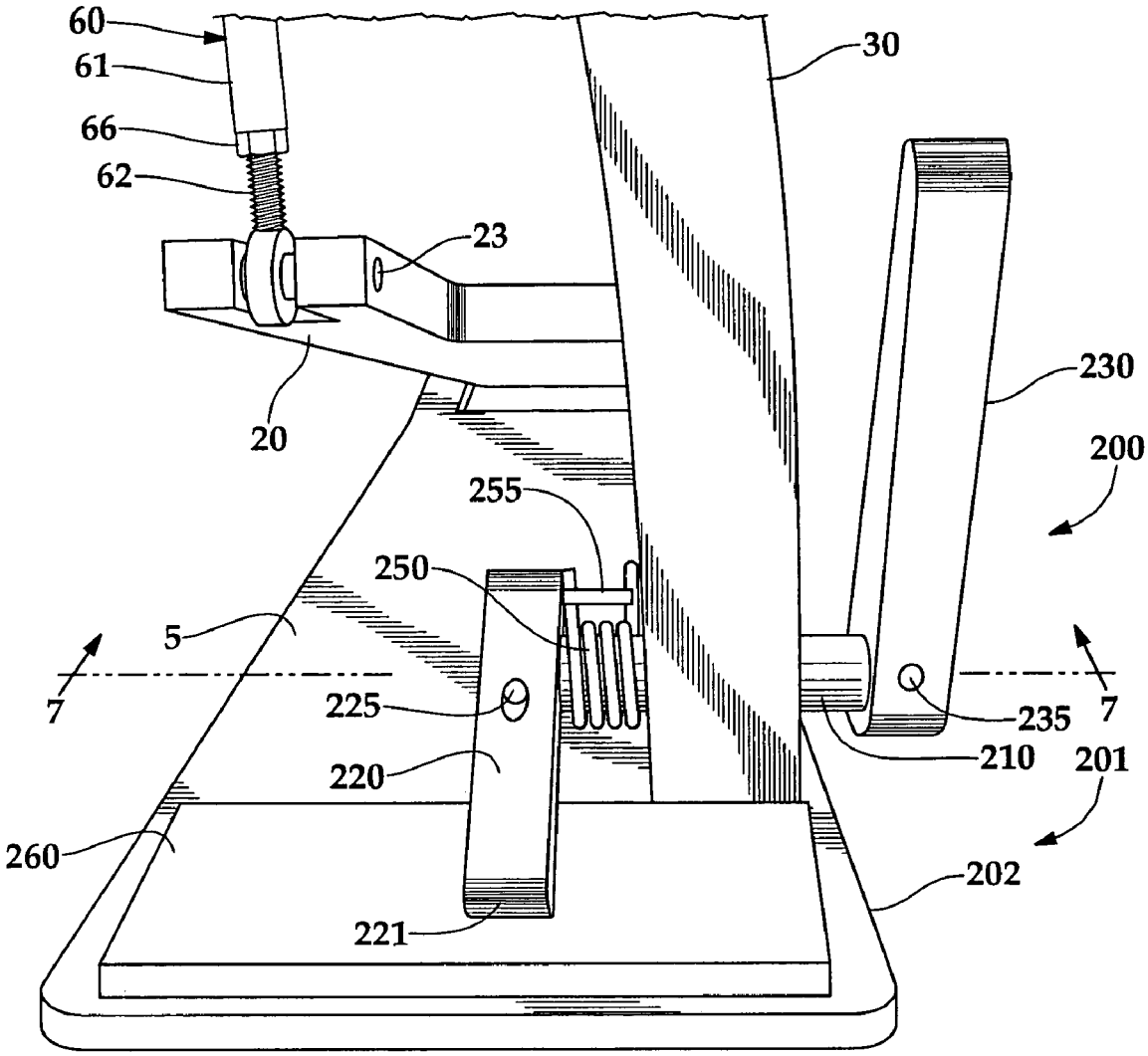
FIG. 6A is a front view of a clamp.
Figure 6B:
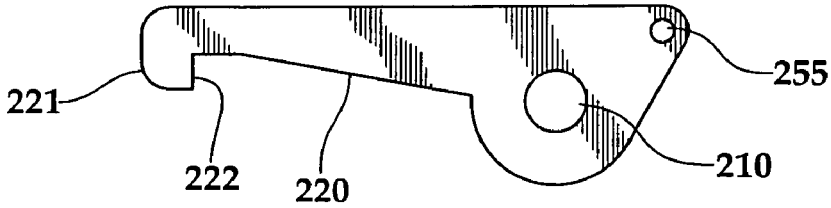
FIG. 6B is a side view of a clamp arm.

In one embodiment, as seen in FIG. 6A, clamp 200 comprises shaft 210 extending through the base of pedestal 30, arm 220 affixed to shaft 210 by arm screw 225, lever 230 affixed to shaft 210 by lever screw 235, and torsion spring 250 encircling shaft 210. Rubber 260 placed in front of arm 220 on drumward end 202 of base 5 helps cushion a bass drum when the drum is in position to be played, and also helps hold the drum in place because rubber 260 may be soft and moldable about the bass drum. As seen in FIG. 6B, arm 220 may have rim hook 221 with back surface 222 to securely lock to the drum rim and keep the drum from moving. Rim hook 221 and back surface 222 may contact the drum rim.

As seen in FIG. 7, shaft 210 turns inside bushing 215 that may be integral to pedestal 30. Snap rings 216 fit into grooves 217 in shaft 210 directly next to either side of bushing 215 to hold shaft 210 from shifting in pedestal 30. Arm screw 225 holds arm 220 securely to shaft 210. Lever screw 235 holds lever 230 securely to shaft 210. Torsion spring 250 encircles shaft 210 adjacent to arm 220. Torsion spring 250 biases arm 220 into a locking position with a drum rim.

As seen in FIG. 8, in one embodiment, torsion spring 250 may have two legs, long leg 251 and short leg 252. Torsion spring 250 may be compressed when long leg 251 and short leg 252 are pinched toward each other. In a preferred embodiment, long leg 251 may push against base 5, and short leg 252 may push against stop or pin 255 mounted to arm 220. Torsion spring 250 biases pin 255 and causes arm 220 to lock with a drum rim.

Arm 220 may be positioned as shown in FIG. 6A. Drum clamp 200 may be in the locked position as shown. To unlock drum clamp 200, pressure may be applied to lever 230. In one embodiment, unlocking drum clamp 200 involves torquing lever 230 clockwise towards pedal 20. Preferably, lever 230 may be torqued between about 30 degrees and about 60 degrees toward foot board 20, more preferably between about 40 degrees and about 50 degrees toward foot board 20, and most preferably about 45 degrees toward foot board 20, to achieve an unlocked position. In the unlocked position, the rim of a drum may be placed on rubber 260. Drum clamp 200 should be easy to operate because there are no screws to manipulate to position arm 220 in place to securely hold the rim of a bass drum. In a preferred embodiment, no tools are necessary to move lever 230. Hand strength may be sufficient to move lever 230 and unlock the drum rim from arm 220.

In another embodiment of the invention (not shown), a structure on shaft 210 allows a lever (such as a drum stick) to be operatively engageable to shaft 210 where the lever could rotate shaft 210 to an unlocked position. In other words, a lever may not necessarily have to be affixed to shaft 210.

As shown generally in FIG. 1, in further summary of an adjustability aspect, drum pedal 10 may have base 5, foot board 20, pedestal 30 extending upwardly from base 5, drive assembly 300 supported by pedestal 30 having a journaled drive shaft 40, rotatably adjustable drive ring 50 mounted on drive shaft 40 having arm 56, rotatably adjustable beater ring 70 mounted on drive shaft 40, link 60 connecting foot board 20 with arm 56, beater 100 having stem 101 affixed to beater ring 70, wherein beater 100 is actuated to a forward position when foot board 20 is depressed, and wherein foot board 20 may be biased into a raised position and beater 100 may be biased into a rearward position.

In other aspects, drive assembly 300 may contain at least one bearing 40 enabling drive shaft 40 to rotate. Foot board 20 bias and beater 100 bias may be provided by spring 120. Drive shaft 40 may be journaled within support ring 35, and support ring 35 may have a predetermined axial length sufficient to keep drive shaft 40 aligned substantially axially. Link 60 may be adjustable within a predetermined range of length. Pedestal 30 may be made from an aluminum casting.

As generally shown in FIGS. 2 and 4, drum pedal 10 may have base 5, foot board 20, pedestal 30 extending upwardly from base 5, drive assembly 300 supported by pedestal 30 having journaled drive shaft 40, cam 150 mounted on drive shaft 40 having drive slope 166, spring 120, and cam follower 155, wherein cam 150 and spring 120 cooperate to bias cam follower 155 toward a predetermined rest position, link 60 operatively connecting foot board 20 to drive shaft 40, beater 100 having stem 101 operatively connected to drive assembly 300, wherein cam follower 155 may be moved onto drive slope 166 when foot board 20 may be depressed. Spring 120 may be a compression spring. Drum pedal 10 also may have tension adjuster 90 for spring 120. Cam 150 may be further provided with retention slope 167 and indentation 165 between drive slope 166 and retention slope 167, wherein the predetermined rest position is in indentation 165.

As generally shown in FIGS. 6-8, drum pedal 10 may have drumward end 201, base 5 having drumward end 202, movable foot board 20 situated above base 5, beater 100 operatively connected to foot board 20 and actuated thereby, clamp 200 operatively connected to drumward end 201 of drum pedal 10, having shaft 210, rotatable arm 220 mounted to shaft 210, torsion spring 250 mounted around shaft 210 and biasing arm 220 to lock with a drum rim, and lever 230 operatively connected to shaft 210 rotatable to unlock arm 220 from the drum rim. Drum pedal 10 may also have pedestal 30 extending upwardly from base 5, wherein clamp 200 is operatively connected to pedestal 30. Arm 220 may also have a stop for engaging torsion spring 250. Drumward end 202 may be provided with gripping surface 260 generally opposite arm 220.

IV. Biasing Arm Drum Pedal Embodiment

In biasing arm drum pedal embodiment 310 shown in FIGS. 9-12, drum pedal 310 is substantially the same as drum pedal embodiment 10 previously described, with one notable difference being a different drive assembly 345 to control rotation of drive shaft 340. Drum pedal 310 has pedestal 330 extending upwardly from base 305. Link 360 connects foot board 320 to drive assembly 345. Drive assembly 345 has journaled drive shaft 340 and biasing bearing 490 mounted off center of drive shaft 340. Drive assembly 345 may be supported within support ring 335. Beater 400 may be held by stem 401 in beater ring 370 in holder protrusion 376.

Figure 9:
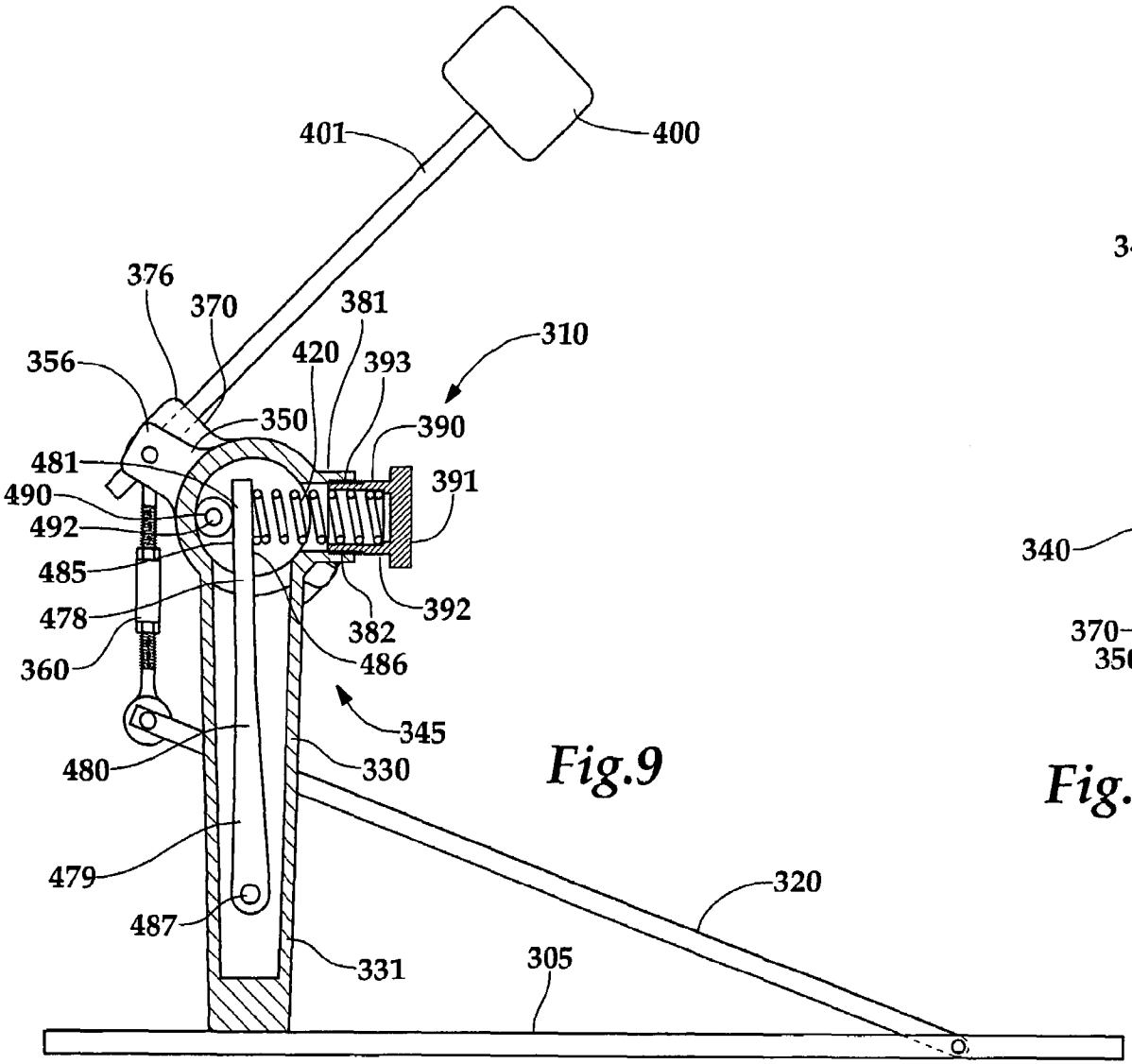
FIG. 9 is a section view of biasing arm embodiment of bass drum pedal in a ready position.
Figures 11, 12:
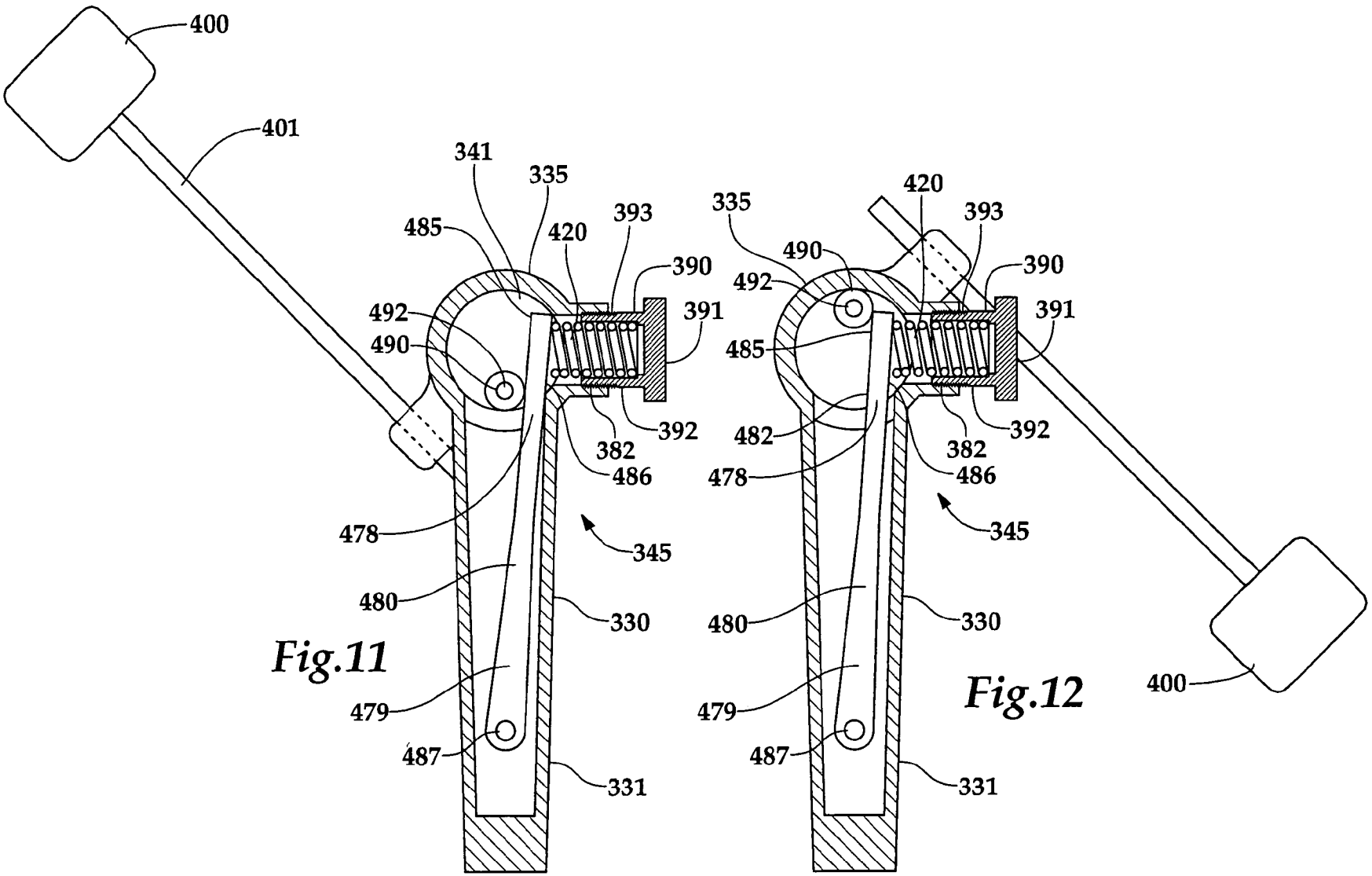
FIG. 11 is a section view similar to FIG. 9 showing a drive mechanism in a forward position.
FIG. 12 is a section view similar to FIG. 9 showing a drive mechanism in a retention position.

As shown in FIGS. 9, 11 and 12, biasing arm 480 has biasing end 478, positioned between biasing bearing 490 and spring 420, and pivot end 479, which may be rotatably connected to bottom portion 331 of pedestal 330 by pivot pin 487. Biasing bearing 490 and spring 420 cooperate together to contact biasing end 478 and position biasing arm 480 in a ready position when foot board 320 is not depressed. When biasing arm 480 is in a ready position, beater 400 is in a rearward position, as shown in FIG. 12, and foot board 320 may be in a raised position. Beater 400 may be actuated to a forward position when foot board 320 is depressed. Biasing arm 480 preferably may be between about 3 inches and about 7 inches in length, more preferably between about 4 inches and about 6 inches in length, and in one embodiment about 5 inches in length. Pivot end 479 may be rotatably connected within about 4 inches from the bottom of pedestal 330, more preferably within about 3 inches from the bottom of pedestal 330, and in one embodiment within 2 inches about the bottom of pedestal 330.

As shown in FIG. 9, spring 420 may be housed within tube support 381 and spring cylinder 392, which is a portion of tension adjuster 390. By twisting knob 391 on tension adjuster 390 counterclockwise, outer threads 393 on spring cylinder 392 screw into inner threads 382 on tube support 381 and compresses spring 420 and thus increases the tension of spring 420. When spring 420 is compressed and spring tension increases, foot board 320 becomes more difficult to depress. Tube support 381 is located at an angle with respect to the longitudinal axis of pedestal 330, preferably at between about 30 and about 150 degrees, more preferably between about 60 and about 120 degrees, and in one embodiment at about 90 degrees with respect to the longitudinal axis of pedestal 330. The angle of tube support 381 should be optimal for a player to adjust the tension of spring 420.

Figure 10:
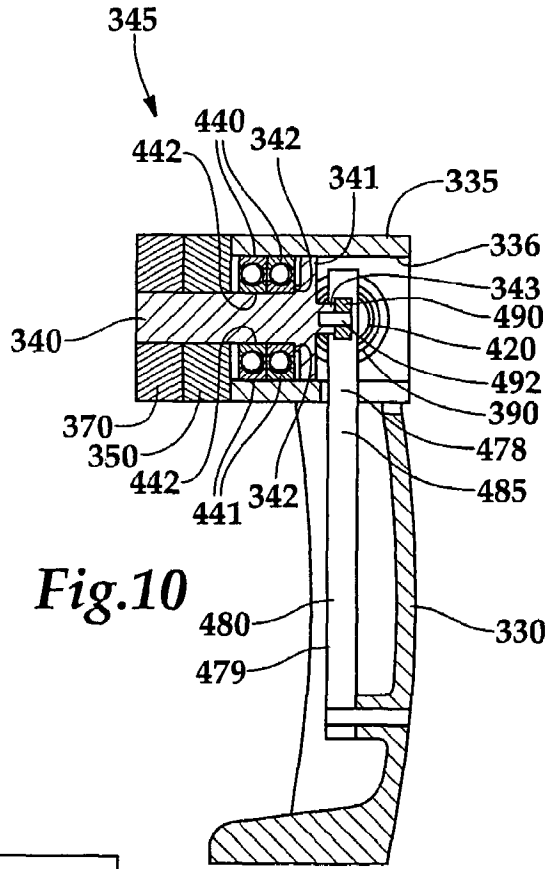
FIG. 10 is a section view of drive mechanism of biasing arm embodiment, enlarged to show details, and rotated 90 degrees from the view of FIG. 9.

As shown in FIGS. 9 and 10, drive assembly 345 is positioned by support ring 335 and comprises drive ring 350 and beater ring 370 clamped to drive shaft 340. Drive ring 350 may have arm 356 that connects to foot board 320 via link 360. Beater ring 370 may have holder protrusion 376 for holding stem 401 of beater 400. As shown in FIG. 10, drive shaft 340 is cylindrically shaped with flange 341 which contacts inner surface 336 of support ring 335 and positions drive shaft 340 securely in a horizontal position. Drive shaft 340 rotates within support ring 335.

As shown in FIG. 10, roller bearings 440 are located within support ring 335 and encircle drive shaft 340. In the embodiment shown, there are two roller bearings 440 adjacent one another along drive shaft 340. Outer raceway 441 of roller bearings 440 contacts inner surface 336 of support ring 335. Inner raceway 442 of roller bearings 440 contact and encircle drive shaft 340. Drive shaft 340 has shoulder 342, adjacent to flange 341, which abuts an end face of inner raceway 442 of one of roller bearings 440. Shoulder 342 spaces roller bearings 440 from flange 341 and ensures roller bearings 440 rotate unimpeaded.

Continuing with FIG. 10, shaft tip 343, as shown in FIGS. 9, 11 and 12, may extend off-center from flange 341. Biasing bearing 490 is locked by bearing pin 492 onto shaft tip 343. Biasing bearing 490 rotates about bearing pin 492 when foot board 320 is depressed.

As shown in FIG. 9-12, biasing end 478 of biasing arm 480 is located between biasing bearing 490 and spring 420. Biasing arm 480 has biasing bearing surface 485 which contacts biasing bearing 490. Biasing arm 480 may be attached near bottom portion 331 of pedestal 330 by biasing arm pivot 487, preferably biasing arm may be in the bottom third of pedestal 330. Spring 420 and biasing bearing 490 cooperate together to position biasing arm 480 towards the ready position, as shown in FIG. 9. At the ready position, spring 420 may be at its most extended state for this embodiment. Biasing arm 480 may be between about one half and about ⅘ of the height of pedestal 330, preferably biasing arm 480 may be between about ⅝ and about ⅞ of the height of pedestal 330, and in the embodiment shown may be about 5/7 of the height of pedestal 330.

As seen in FIGS. 11 and 12, biasing arm 480 has a range of motion of between about 100 degrees and about 250 degrees, preferably a range of between about 130 degrees and about 220 degrees, and in the embodiment shown a range of about 180 degrees. From ready position, beater 400 rotates toward the drum at a range of between about 60 degrees and about 120 degrees, preferably between about 80 degrees and about 100 degrees, and in the embodiment shown about 90 degrees. When beater 400 contacts the surface of the drum, biasing arm 480 may be in an actuated position in which foot board 320 (see FIG. 9) may be depressed and beater 400 may be in a forward position, as shown in FIG. 11. From the ready position as shown in FIG. 9, beater can rotate backwardly (i.e., away from the drum) at a range of between about 60 degrees and about 120 degrees, preferably between about 80 degrees and about 100 degrees, and in the embodiment shown about 90 degrees.

Spring 420 may be a compression spring and the spring tension coupled with biasing bearing 490 on drive shaft 340 (see FIG. 110) may force biasing arm 480 to the ready position, as shown in FIG. 9. Spring 420 contacts biasing spring surface 486 of biasing arm 480. Tension of spring 420 may be adjusted by twisting tension adjuster 390. Tension adjuster 390 has knob 391 and spring cylinder 392. Spring 420 may be housed within tube support 381 and spring cylinder 392. As noted above, spring cylinder 392 has outer threads 393 that engage inner threads 382 on tube support 381. This engagement holds tension adjuster 390 in place and controls the compression of spring 420.

Biasing bearing surface 485 may have three positions, a rest position, an actuated position, and a retention position. As shown in FIG. 9, at the ready position, biasing bearing 490 may be in the rest position because spring 420 is at its most extended state and therefore at its lowest potential energy. In FIG. 11, when foot board 320 is depressed, and drive shaft 340 rotates to the forward position, biasing bearing 490 rolls along biasing bearing surface 485 into the actuated position. When biasing bearing 490 is in the actuated position, spring 420 compresses and the spring tension increases. Upon release of foot board 320, the spring tension of compressed spring 420 forces biasing bearing 490 to roll back along biasing bearing surface 485 toward the rest position.

As shown in FIG. 12, after the foot board is released, biasing bearing 490 will roll along biasing bearing surface 485 toward the rest position. If biasing bearing 490 rolls past the rest position on biasing bearing surface 485, where spring 420 is most extended, then biasing bearing 490 will roll along biasing bearing surface 485 towards a retention position and compress spring 420 and increase spring tension. When biasing bearing 490 is in the retention position, the spring tension will cause biasing bearing 490 to roll back along biasing bearing surface 485 towards the rest position. The retention position ensures that biasing bearing 490 returns to the rest position, and biasing arm 480 returns to the ready position when the foot board is not depressed.

V. Drum Clamp Mounted in Bracket

As generally shown in FIGS. 13-17, in one embodiment, a drum pedal may have drumward clamp 600 including shaft 610 extending through shaft housing 611, rotatable arm 620, lever 630, torsion spring 650, and adjustable bracket 670. Clamp 600 may be attached to a drum pedal to hold and position the drum pedal behind a bass drum pedal. A drum pedal may have base 605 and may have drumward end 602.

Figure 13:
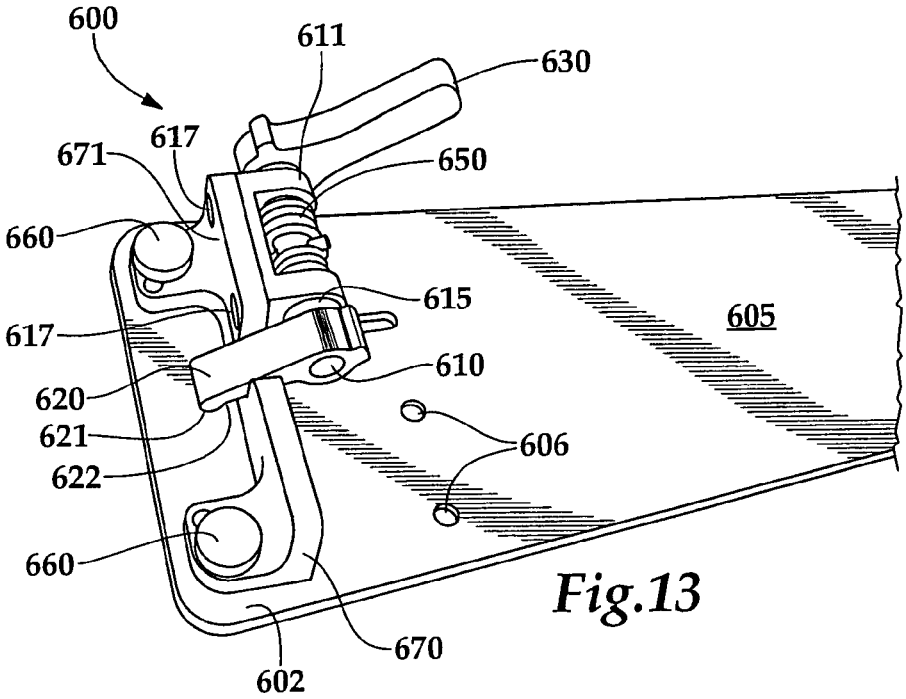
FIG. 13 is a perspective view of a drum pedal base with a clamp.
Figure 17:
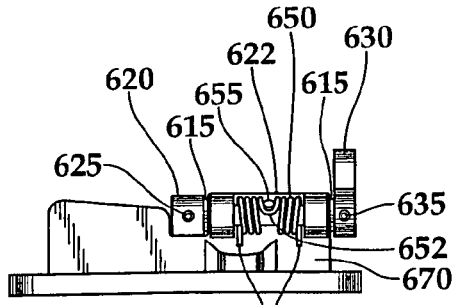
FIG. 17 is a reduced back view of a drum pedal base with a clamp.

As seen in FIG. 13, shaft 610 turns inside bushings 615 that may be integral with shaft housing 611. Shaft housing screws 617 hold shaft housing 611 securely to positioning bracket 670. As shown in FIG. 17, arm 620 is affixed to shaft 610 by arm screw 625. Lever 630 is connected to shaft 610 by lever screw 635. Bushings 615 encircle and prevent shaft 610 from shifting in shaft housing 611.

As seen in FIG. 17, in one embodiment, torsion spring 650 encircles shaft 610 between bushings 615. Torsion spring 650 may have stop legs 651 and stop loop 652. Torsion spring 650 may be compressed when stop legs 651 and stop loop 652 are pinched toward one another. In a preferred embodiment, stop legs 651 may push against positioning bracket 670, and stop loop 652 may push against stop pin 655 mounted to shaft 610.

Torsion spring 650 biases stop pin 655 upwardly and biases arm 620 downwardly to engage with a drum rim.

Arm 620 may be positioned as shown in FIG. 13. Torsion spring 650 biases arm 620 into a locking position. Arm 620 may have rounded protrusion 621 with back surface 622 for contacting and securely locking to a drum rim and for keeping the drum from moving. Rubber pads 660 placed on drumward end 602 of base 605 help cushion a bass drum when the drum is in position to be played. The rubber pads 660 may be soft and moldable to the contacting surface of the bass drum.

Figure 14:
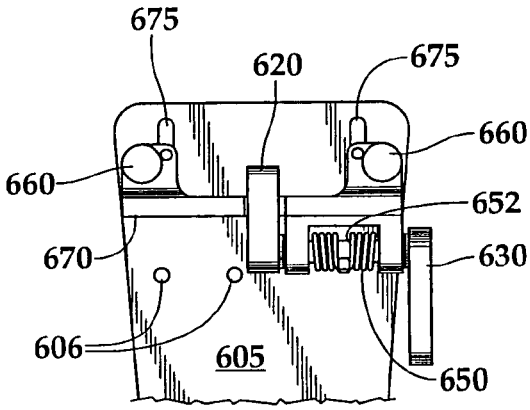
FIG. 14 is a reduced top view of a drum pedal base with a clamp.
Figure 15:
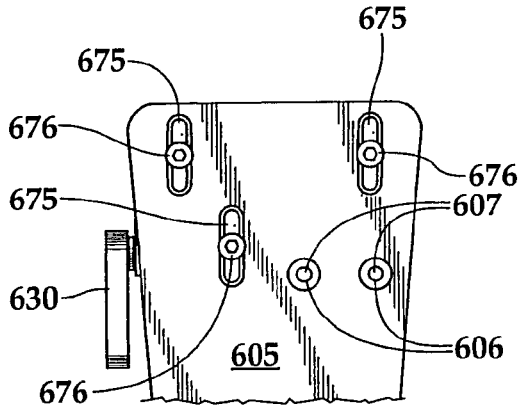
FIG. 15 is a reduced bottom view of a drum pedal base with a clamp.
Figure 16:
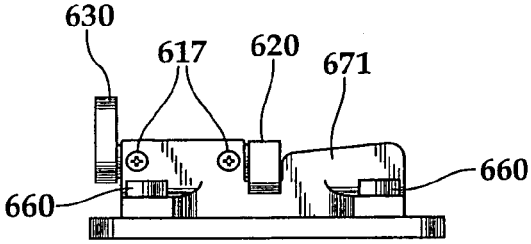
FIG. 16 is a reduced front view of a drum pedal base with a clamp.

As seen in FIGS. 13-15, a pedestal (not shown) may be securely mounted to base 605 using pedestal mounting holes 606 and pedestal mounting screws 607. Base 605 also has positioning bracket slots 675 allowing positioning bracket 670 to slide toward and away from drumward end 602. Positioning bracket slots 675 accommodate for different hoop depths of drums by allowing for positioning bracket 670 to be adjustably mounted at a minimum distance from the drum head surface. Preferably, positioning bracket 670 has a range of motion between about 0.3 inch and about 2.0 inch, more preferably between about 0.5 inch and 1.5 inch, and in the embodiment shown about 1.0 inch. After proper orientation, positioning bracket 670 may be secured to base 605 with positioning bracket screws 676.

As seen in FIG. 13, drum clamp 600 may be positioned in the locked position, which is the natural position due to biasing by torsion spring 650. To unlock drum clamp 600, pressure may be applied to lever 630 causing arm 620 to rotate. In one embodiment, unlocking drum clamp 600 involves torquing lever 630 away from drumward end 602. Lever 630 may be torqued between about 30 degrees and about 60 degrees away from drumward end 602, more preferably between about 40 degrees and 50 degrees away from drumward end 602, and in the embodiment shown about 45 degrees from drumward end, to achieve a maximum unlocked position. In the unlocked position, the rim of a drum may be placed under arm 620 on rubber pads 660. Stop surface 671 on positioning bracket 670 acts as a stop for a drum rim. Drum clamp 600 should be easy to operate because no tools are necessary to move lever 630. Hand strength may be sufficient to move lever 630 and unlock arm 620 from a drum rim.

VI. Link with Plurality of Positions

Figure 19:
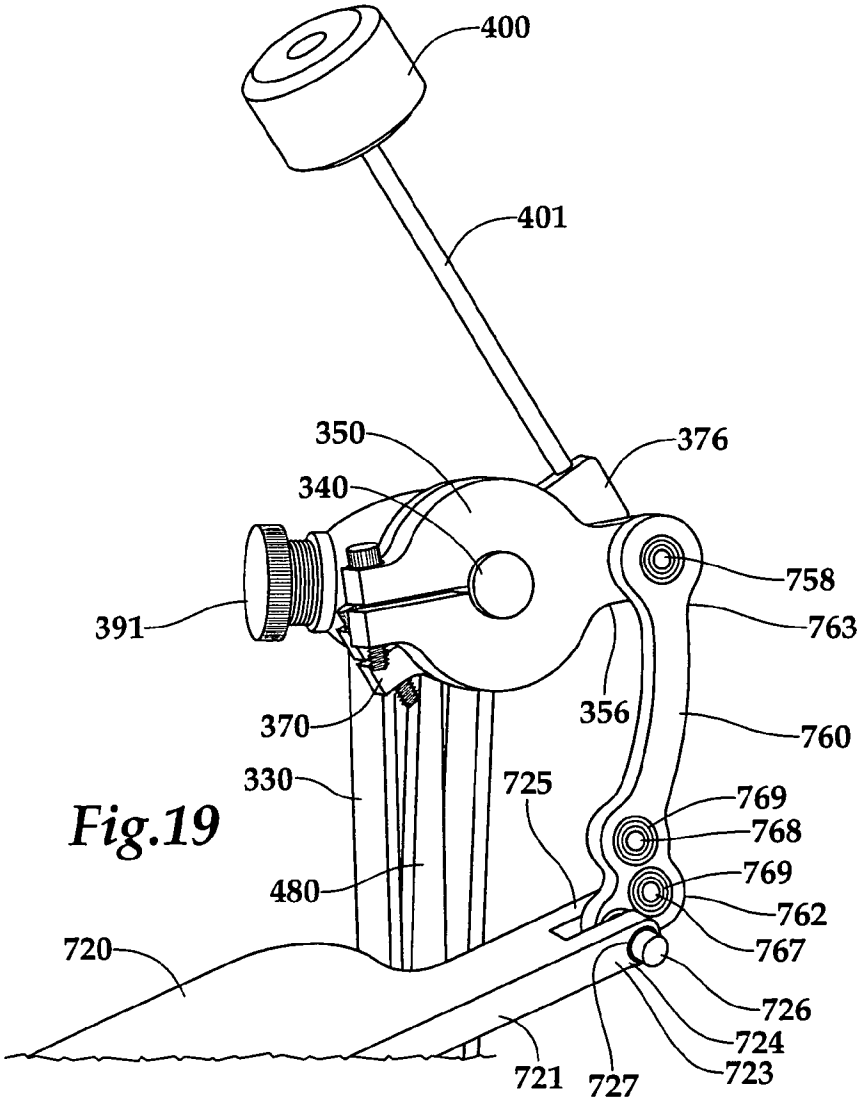
FIG. 19 is a perspective view of a link attached to a drive ring and a foot board.
Figure 18:
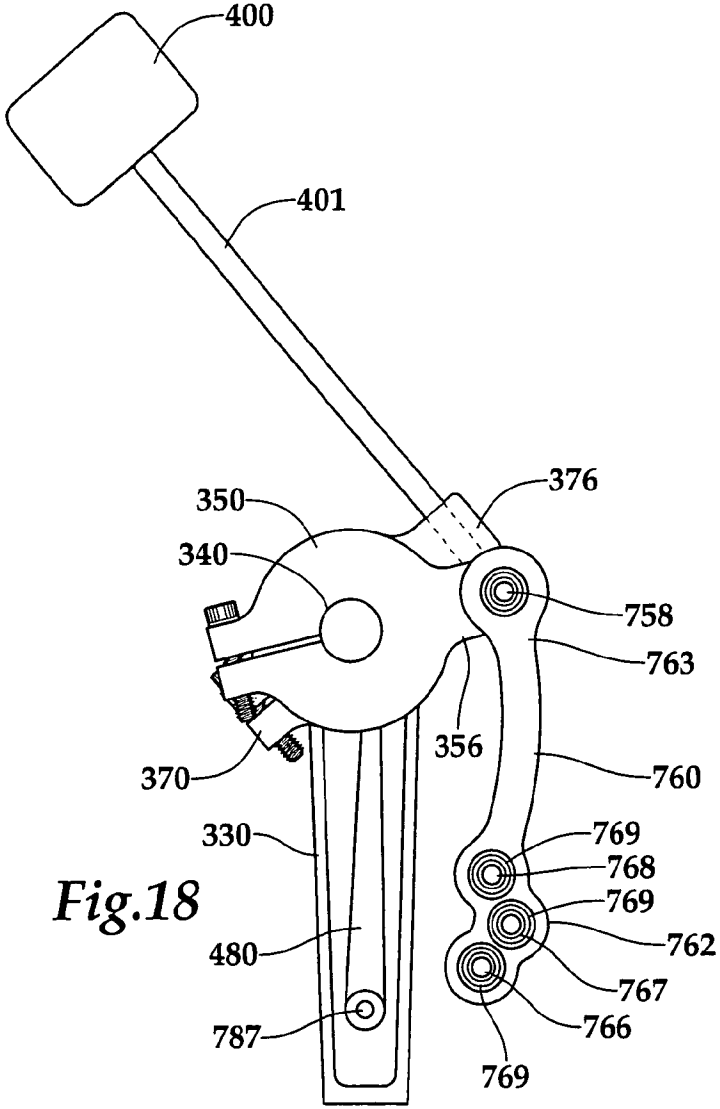
FIG. 18 is a side view of a link attached to a drive ring of a drum pedal.

As shown in FIGS. 18 and 19, a drum pedal may have an alternate form of link 760 operatively linking drive ring 350 to foot board 720, see FIG. 19. Drive ring 350 clamps around drive shaft 340. Link 760 may have toe portion 762 and drive portion 763 which may engage drive ring 750 at arm 756 by link pin 758. Toe portion 762 may have a plurality of positions for adjustably connecting to, and adjusting the height of toe end 721 of foot board 720.

As shown in FIGS. 18 and 19, toe portion 762 of link 760 may have between one and about five positions, preferably between about two and about four positions, and in the embodiment shown about three positions. Positions may be defined by bearings 769 having open centers or holes 766, 767 and 768 for receiving foot board pin 726. Hole 766 may be the position furthest from drive portion 763. Hole 768 may be the position closest to drive portion 763. Hole 767 may be between hole 766 and hole 768 and may be offset from both hole 766 and hole 768. Bearings 769 may be positioned to enable pivoting in one of holes 766, 767, or 768 by foot board pin 726.

The foot board 720 may have toe end 721 which may have a U-shaped tip 723 that receives and engages toe portion 762. U-shaped tip 723 may comprise parallel legs 724 and 725. Foot board pin 726 may fit in foot board toe hole 727 of leg 724, one of holes 766, 767, or 768 and a hole or bore in leg 725. Toe portion 762 fits between leg 724 and leg 725 such that one of holes 766, 767, or 768 lines up with foot board toe hole 727.

Toe end 721 of foot board 720 may be raised and lowered in height by lining up one of holes 766, 767, or 768 with foot board toe hole 727 and positioning foot board pin 726 through both holes and in a hole or dimple in leg 725. Positioning foot board pin 726 in hole 766 places foot board 720 in the lowest position because link 760 is longest. Positioning foot board pin 726 in hole 768 places foot board 720 in the highest position because link 760 is shortest. Placing foot board pin 726 in hole 767 places foot board 720 in an intermediate position. Having three height options for foot board 720 allows each drummer to find a comfortable position.

As shown generally in FIGS. 9-19, in summary of biasing arm embodiment 310, a drum pedal may have base 305, foot board 320, pedestal 330 with a longitudinal axis, drive assembly 345 supported by pedestal 330 having journaled drive shaft 340, rotatatable bearing 490 mounted off center of drive shaft 340, spring 420, biasing arm 480 pivotally mounted on pedestal 330, wherein bearing 490 and spring 420 cooperate to bias biasing arm 480 toward predetermined rest position 481, a linkage operatively connecting foot board 320 to drive shaft 340, beater 400 operatively connected to drive shaft 340, wherein bearing 390 displaces biasing arm 380 and compresses spring 420 when foot board 320 is depressed. Drum pedal 310 may also have tension adjuster 390 for spring 420, wherein tension adjuster 390 forms an angle between about 30 degrees and about 150 degrees with respect to the longitudinal axis of pedestal 330. Beater 400 may have stem 401 operatively connected to drive assembly 345 and may be actuated to a forward position when foot board 320 is depressed and to a rearward position when foot board 320 is not depressed. Drum pedal 310 may have a ready position wherein biasing arm 480 is in a rest position, beater 400 is in a rearward position, and foot board 320 is in a raised position. Biasing arm 480 may be in the actuated position when foot board 320 is depressed and beater 400 is in the forward position.

A drum pedal may have base 305, foot board 320, pedestal 330 with an axis extending upwardly from base 305, drive assembly 345 supported by pedestal 330 having journaled drive shaft 340, and a linkage operatively connecting foot board 320 to drive shaft 340, wherein the linkage includes an elongate link 760 having toe portion 762 and drive portion 763, wherein toe portion 762 has means for selectively defining a connection to the foot board from one of a plurality of positions. The plurality of positions may be between one and about five positions. The means may be bearings 769 having open centers for receiving foot board pin 726.

A drum pedal may have base 605 having drumward end 602, a moveable foot board situated above base 605, a beater operatively connected to the foot board and actuated thereby, bracket 670 mountable to drumward end 602, and clamp 600 operatively connected to bracket 670, having shaft 610, rotatable arm 620 mounted to shaft 610, torsion spring 650 mounted around shaft 610 and biasing arm 620 to lock with a drum rim, and lever 630 operatively connectable to shaft 610 rotatable to unlock arm 620 from the drum rim. Arm 620 may have stop loop 652 for engaging spring 650 and may have protrusion 621 for locking to the drum rim. Drumward end 602 may have a gripping surface generally opposite arm 620. Bracket 670 relative to drumward end 602 may be adjustable along a range of positions, between about 0.3 inches and about 2 inches.

Since many possible embodiments may be made of the invention without departing from the scope thereof, it is understood that all matter herein set forth or shown in the accompanying drawings is to be interpreted as illustrative, and not in a limiting sense.

We claim:

1. A drum pedal comprising:

a base;

a foot board;

a pedestal with an axis extending upwardly from said base;

a drive assembly supported by said pedestal comprising a journaled drive shaft, a rotatable bearing mounted off center of said drive shaft, a spring, and a biasing arm pivotally mounted on said pedestal, said biasing arm positioned between said rotatable bearing and said spring, wherein said bearing and said spring cooperate to bias said arm toward a predetermined rest position;

a linkage operatively connecting said foot board to said journaled drive shaft;

a beater operatively connected to said journaled drive shaft, wherein said bearing displaces said arm and compresses said spring when said foot board is depressed.

2. A drum pedal according to claim 1, further comprising a tension adjuster for said spring, wherein said tension adjuster forms an angle between about 30 degrees and about 150 degrees with respect to said pedestal axis.

3. A drum pedal according to claim 1, wherein said beater has a stem operatively connected to said drive assembly, wherein said beater is actuated to a forward position when said foot board is depressed and to a rearward position when said foot board is not depressed.

4. A drum pedal according to claim 1, further comprising a ready position wherein said arm is in said rest position, said beater is in a rearward position, and said foot board is in a raised position.

5. A drum pedal according to claim 1, further comprising an actuated position, wherein said arm is in said actuated position when said foot board is depressed and said beater is in said forward position.

6. A drum pedal comprising:

a base;

a foot board;

a pedestal with an axis extending upwardly from said base;

a drive assembly supported by said pedestal comprising a journaled drive shaft;

a beater operatively connected to said journaled drive shaft; and a linkage operatively connecting said foot board to said journaled drive shaft, wherein said linkage includes an elongate link having a toe portion and a drive portion, wherein said toe portion has means for selectively connecting said foot board to one of a plurality of positions on said toe portion.

7. A drum pedal according to claim 6, wherein said plurality of positions comprises between one and about five positions.

8. A drum pedal according to claim 6, wherein said means comprises bearings having open centers for receiving a pin.

9. A drum pedal comprising:

a base having a drumward end;

a moveable foot board situated above said base;

a beater operatively coupled to said foot board and actuated thereby;

a bracket mountable to said drumward end; and a clamp operatively connected to said bracket, said clamp comprising a shaft, a rotatable arm mounted to said shaft, a torsion spring mounted around said shaft and biasing said arm to lock with a drum rim, and a lever operatively connectable to said shaft and rotatable to lock and unlock said arm from said drum rim.

10. A drum pedal according to claim 9, wherein said arm has a stop for engaging said spring.

11. A drum pedal according to claim 9, wherein said arm is provided with a protrusion for locking with said drum rim.

12. A drum pedal according to claim 9, wherein said drumward end is provided with a gripping surface generally opposite said arm.

13. A drum pedal according to claim 9, wherein said bracket relative to said drumward end is adjustable along a range of positions.

14. A drum pedal according to claim 13, wherein said range is defined by a plurality of slots in said base, each having a length of between about 0.3 inches and about 2 inches.

15. An adjustable drum pedal comprising:

a base;

a foot board;

a pedestal extending upwardly from said base;

a drive assembly supported by said pedestal, comprising a drive shaft, a drive ring mounted on said drive shaft having an arm, and a beater ring mounted on said drive shaft, wherein said drive ring and said beater ring are separately, rotatably adjustable with respect to said drive shaft;

a link connecting said foot board to said arm; and a beater having a stem connected to said beater ring, wherein said beater is actuated to a forward position when the foot board is depressed;

wherein said foot board is biased toward a raised position and said beater is biased toward a rearward position.

16. An adjustable drum pedal according to claim 15, wherein said foot board bias and said beater bias are provided by a spring.

17. An adjustable drum pedal according to claim 15, wherein said drive shaft is journaled within a support ring.

18. An adjustable drum pedal according to claim 17, wherein said support ring has a predetermined axial length sufficient to keep said drive shaft aligned substantially axially.

* * * * *